US006526869B2

(12) United States Patent
Kato et al.

(10) Patent No.: US 6,526,869 B2
(45) **Date of Patent: *Mar. 4, 2003**

(54) PISTON FOR COMPRESSORS AND METHOD FOR PRODUCING THE SAME

(75) Inventors: Takayuki Kato, Kariya (JP); Takahiro Hoshida, Kariya (JP); Seiji Katayama, Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/824,313

(22) Filed: Apr. 2, 2001

(65) Prior Publication Data

US 2001/0025567 A1 Oct. 4, 2001

(30) Foreign Application Priority Data

Apr. 3, 2000 (JP) ..... 2000-101025

(51) Int. Cl.[7] ..... F16J 1/00
(52) U.S. Cl. ..... 92/176
(58) Field of Search ..... 92/172, 176, 255, 92/260; 417/269; 29/888.04, 888.042, 888.044, 888.047, 557

(56) References Cited

U.S. PATENT DOCUMENTS

| | | | | |
|---|---|---|---|---|
| 1,061,922 A | | 5/1913 | Patrick | |
| 1,279,184 A | * | 9/1918 | Vincent | 29/888.044 |
| 1,490,849 A | | 4/1924 | Philip | |
| 1,818,085 A | | 8/1931 | Nelson | |
| 1,841,796 A | | 1/1932 | Edwards | |
| 2,024,286 A | | 12/1935 | Handler | |
| 2,539,903 A | | 1/1951 | Gruetien | 29/156.5 |
| 3,731,596 A | | 5/1973 | Burgdorf | 92/52 |
| 4,073,220 A | | 2/1978 | Guenther | 92/190 |
| 4,191,095 A | * | 3/1980 | Heyl | 91/488 |
| 4,519,436 A | | 5/1985 | Ebisawa et al. | 164/120 |
| 4,532,686 A | | 8/1985 | Berchem | 29/156.5 R |
| 4,829,954 A | | 5/1989 | Morgado | 123/193 |
| 5,174,728 A | | 12/1992 | Kimura et al. | 417/222.2 |
| 5,586,483 A | | 12/1996 | Sine | 92/255 |
| 5,878,652 A | | 3/1999 | Kottke | 92/258 |
| 5,913,960 A | | 6/1999 | Fletcher-Jones | 92/219 |
| 6,038,960 A | | 3/2000 | Fukushima et al. | 92/12.2 |

FOREIGN PATENT DOCUMENTS

| | | | |
|---|---|---|---|
| CH | 675455 A5 | 9/1990 | F04B/39/04 |
| DE | 4114985 | 11/1992 | B22D/17/22 |
| EP | 0 952 339 A2 | 10/1999 | F04B/27/08 |
| JP | 10-077965 | 3/1998 | F04B/27/08 |
| JP | 10-281065 | 10/1998 | F04B/39/00 |
| JP | 11-107912 | 4/1999 | F04B/27/08 |
| JP | 11-257218 | 9/1999 | F04B/27/08 |
| JP | 11-294320 | 10/1999 | F04B/27/08 |

* cited by examiner

*Primary Examiner*—Edward K. Look
*Assistant Examiner*—Michael Leslie
(74) *Attorney, Agent, or Firm*—Morgan & Finnegan, LLP

(57) ABSTRACT

A hollow piston has an end wall that receives the pressure of a cylinder bore of a compressor. Several reinforcing ribs are formed on the inner end face of the end wall. The ribs extend radially from the axis of the piston. Therefore, the piston is light and strong.

19 Claims, 10 Drawing Sheets

1 (b)
L
11
12
13
14
15
16
17
18
19
20
21
22
23
24
25
26
27
28
29
30
31
32
33
34
35
36
37
39
111
121
141
171
191
192
201
202
211
221
231
331
351

PISTON FOR COMPRESSORS AND METHOD FOR PRODUCING THE SAME

BACKGROUND OF THE INVENTION

The present invention relates to a hollow piston, which is reciprocated by rotation of a cam body that rotates integrally with a rotary shaft and a method for producing the same.

A piston disclosed in Japanese Patent Unexamined Publication No. Hei 11-107912 is hollow to reduce its weight. Such a hollow piston improves displacement control for variable displacement type compressors, which control the inclination angle of a swash plate by controlling the pressure in a crank chamber.

The weight of a hollow piston can be reduced by reducing the thickness of a wall surrounding the hollow portion. The pressure of refrigerant gas is applied to the head end of the piston, which reciprocates inside the cylinder bore.

The head end wall of the piston is flat. However, if the head end is too thin, the piston will not have the strength required to withstand the pressure in the cylinder bore.

SUMMARY OF THE INVENTION

An object of the present invention is to reduce the weight of a hollow piston by reducing the weight of the head end wall of the piston.

To achieve the foregoing and other objectives and in accordance with the purpose of the present invention, a hollow piston used in a compressor is provided. The piston is accommodated in a cylinder bore of the compressor. The piston includes an end wall. The end wall receives the pressure of the cylinder bore. The end wall having an outer end face and an inner end face that is opposite to the outer end face. A reinforcing protrusion is formed on the inner end face and is radially symmetrical.

The present invention may be applied to a method for manufacturing a hollow piston used in a compressor. The piston includes a head piece and a body piece that is coupled to the head piece. The head piece has an end wall that receives the pressure of a cylinder bore of the compressor. The body piece includes the remainder of the piston. The end wall has an outer end face and an inner end face that is opposite to the outer end face. The method includes preparing a mold for forming the head piece, wherein the mold is designed such that a temporary protrusion is formed on the inner end face, pouring molten metal into the mold, pushing the temporary protrusion before the molten metal solidifies to prevent formation of shrinkage cavities, and removing part of the temporary protrusion after the molten metal solidifies, wherein the remainder of the temporary protrusion serves as a reinforcing protrusion.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which:

FIG. 1(*b*) is a cross-sectional view taken along the line 1(*b*)—1(*b*) in FIG. 1(*a*);

FIG. 7(*b*) is a cross-sectional view taken along the line 7(*b*)—7(*b*) in FIG. 7(*a*);

FIG. 8(*b*) is a cross-sectional view taken along the line 8(*a*)—8(*a*) in FIG. 8(*a*);

FIG. 9(*b*) is a cross-sectional view taken along the line 9(*b*)—9(*b*) in FIG. 9(*a*);

FIG. 10(*b*) is a cross-sectional view taken along the line 10(*b*)—10(*b*) in FIG. 10(*a*);

FIG. 11(*b*) is a cross-sectional view taken along the line 11(*b*)—11(*b*) in FIG. 11(*a*);

FIG. 12(*b*) is a cross-sectional view taken along the line 12(*b*)—12(*b*) in FIG. 12(*a*);

FIG. 13(*b*) is a cross-sectional view taken along the line 13(*b*)—13(*b*) in FIG. 13(*a*);

FIG. 14(*b*) is a cross-sectional view taken along the line 14(*b*)—14(*b*) in FIG. 14(*a*);

FIG. 15(*b*) is a cross-sectional view taken along the line 15(*b*)—15(*b*) in FIG. 15(*a*);

FIG. 19(*b*) is a cross-sectional side view illustrating a protrusion 54 for preventing shrinkage of a cavity.

DETAILED DESCRIPTION OF THE PREFERRED EMBODIMENTS

Figure 4:
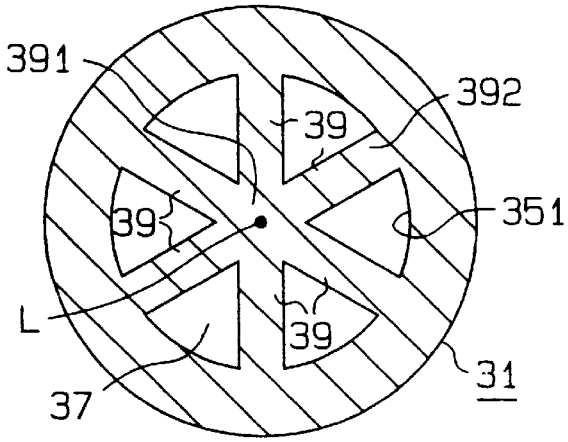
FIG. 4 is a cross-sectional view taken along the line 4—4 in FIG. 2.

A first embodiment of the present invention will be described below with reference to FIG. 1(*a*) to FIG. 4.

Figure 1:
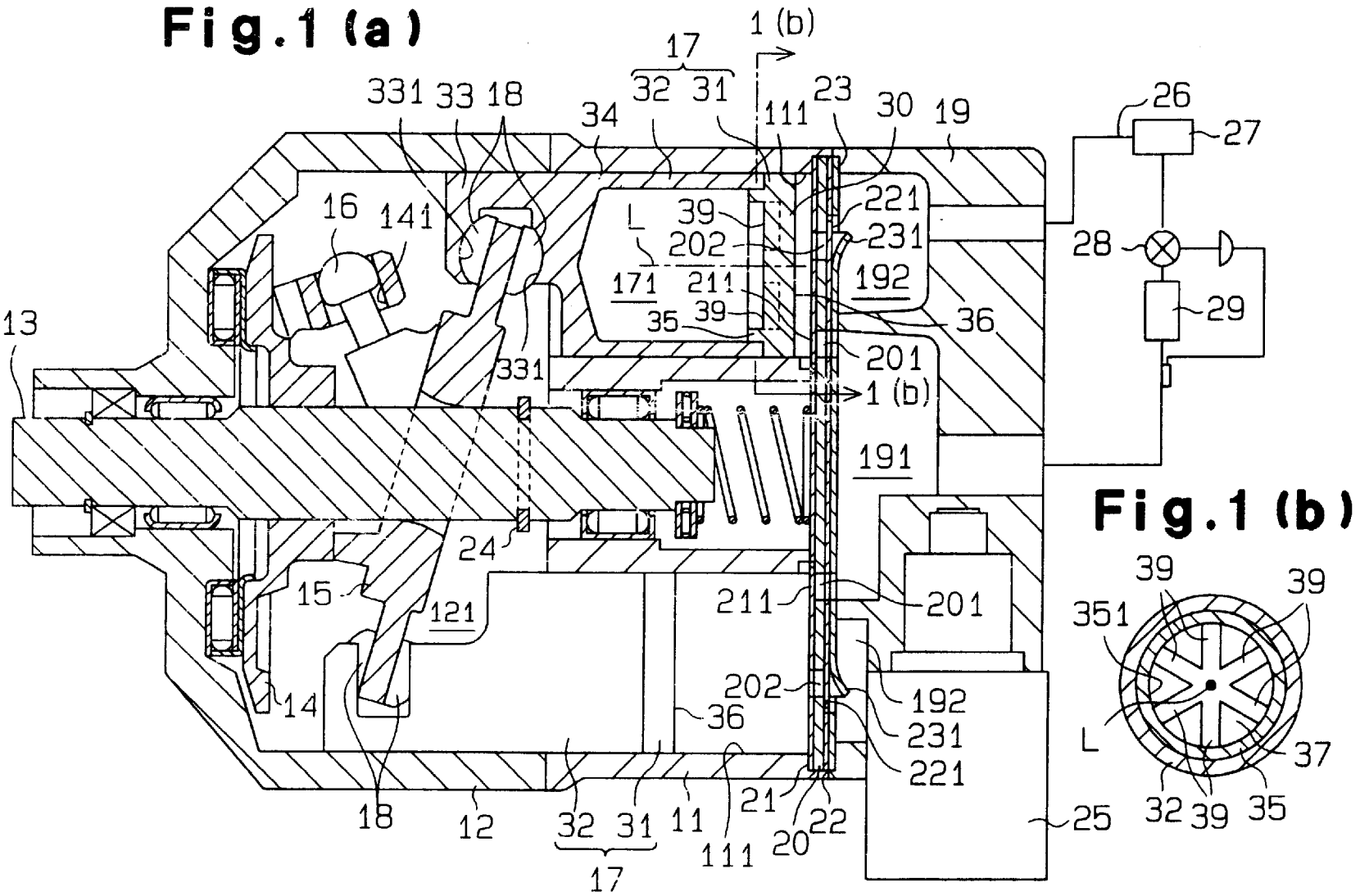
FIG. 1(*a*) is a cross-sectional side view of a compressor according to a first embodiment of the present invention.

FIG. 1(*a*) shows the internal structure of a variable displacement type compressor. A front housing 12 and a cylinder block 11 form a controlled pressure chamber, or a crank chamber 121, and a drive shaft 13 is supported in the crank chamber 121. The drive shaft 13 is driven by an external driving source (for example, a vehicle engine). A rotary support 14 is secured to the drive shaft 13, and a swash plate 15 is supported on the drive shaft 13 to slide in the axial direction of the drive shaft 13 and to incline with respect to the drive shaft 13. A guide pin 16 that is fixed to the swash plate 15 is pivotally fitted into a guide hole 141 that is formed onto a rotary support 14. The swash plate 15 is movable in the axial direction of the drive shaft 13 and rotatable together with the drive shaft 13 in concert with the guide hole 141 and the guide pin 16.

The inclination of the swash plate 15 is permitted by the pivotal relationship between the guide hole 141 and the guide pin 16 and by the sliding relationship between the drive shaft 13 and the swash plate 15.

The inclination angle of the swash plate 15 can be changed in accordance with the pressure of the crank chamber 121. The inclination angle of the swash plate 15 decreases as the pressure in the crank chamber 121 increases, and it increases as the pressure in the crank chamber 121 decreases. The refrigerant in the crank chamber 121 flows into a suction chamber 191 through an unillustrated pressure release passage, and the refrigerant in a discharge chamber 192, which is in a rear housing 19, is conducted to the crank chamber 121 through a pressure supply passage (not shown). A displacement control valve 25 is located in the pressure supply passage, and the flow rate of the refrigerant supplied from the discharge chamber 192 to the crank chamber 121 is controlled by the displacement control valve 25. The pressure in the crank chamber 121 increases as the flow rate of the refrigerant supplied from the discharge chamber 192 to the crank chamber 121 increases, and the pressure in the crank chamber 121 decreases as the flow rate of the refrigerant supplied from the discharge chamber 192 to the crank chamber 121 decreases. In other words, the inclination angle of the swash plate 15 is controlled by the displacement control valve 25.

The maximum inclination angle of the swash plate 15 is defined by direct contact between the swash plate 15 and the rotary support 14. The minimum inclination angle of the swash plate 15 is defined by direct contact between a snap ring 24 on the drive shaft 13 and the swash plate 15.

In the cylinder block 11, a plurality of cylinder bores 111 (only two are shown in the drawing) are arranged around the drive shaft 13. An aluminum piston 17 is housed in each cylinder bore 111. The rotation of the swash plate 15 is converted into the reciprocating movement of the pistons 17 via shoes 18. The shoes 18 contact and slide with respect to the swash plate 15.

The refrigerant in the suction chamber 191 flows into one of the cylinder bores 111 and opens a corresponding suction valve 211, which is formed by an inner valve forming plate 21, from a corresponding suction port 201, which is formed in a valve plate 20, when the corresponding piton moves from right side to left in FIG. 1(*a*).

The refrigerant in the cylinder bore 111 is discharged into the discharge chamber 192, which pushes aside a corresponding discharge valve 221 that is formed on an outer valve forming plate 22, through a discharge port 202 when the corresponding piston 17 moves from left to right side in FIG. 1(*a*). Each discharge valve 221 contacts a corresponding retainer 231, which is formed on a retainer forming plate 23. The retainers 231 limit the maximum opening degree of the discharge valves 221.

The discharge chamber 192 and the suction chamber 191 are connected with each other through an external refrigerant circuit 26.

The refrigerant flowing from the discharge chamber 192 to the external refrigerant circuit 26 is circulated to the suction chamber 191 through a condenser 27, an expansion valve 28, and an evaporator 29.

Figure 2:
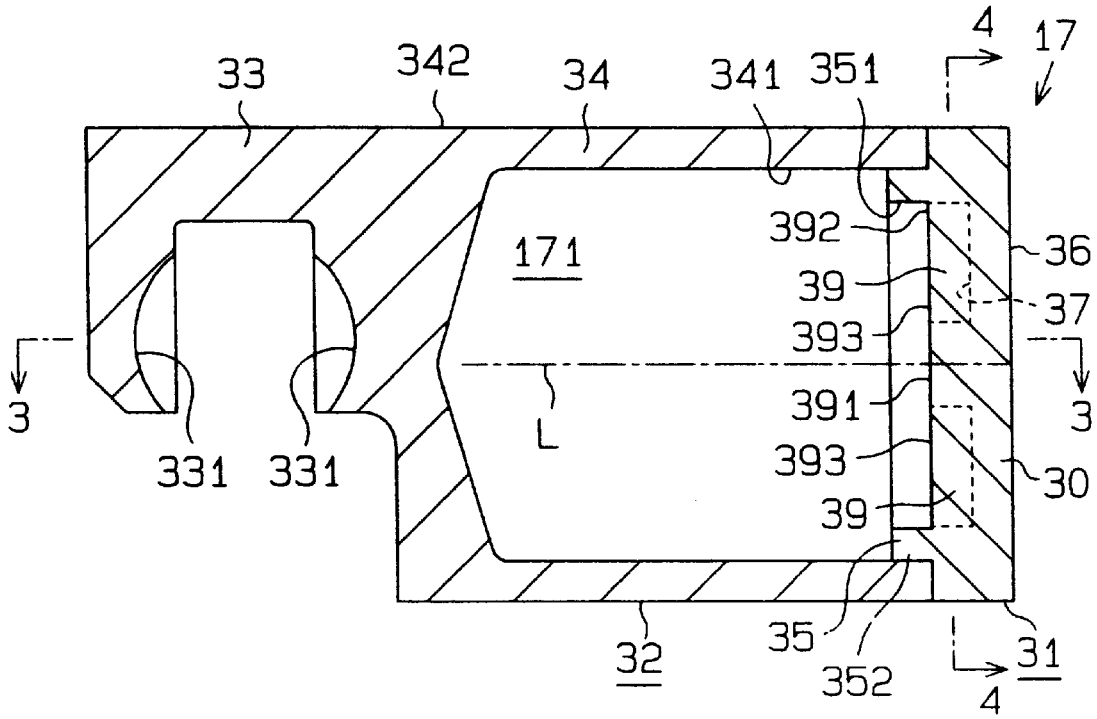
FIG. 2 is a cross-sectional side view of the piston of FIG. 1(*a*)
Figure 3:
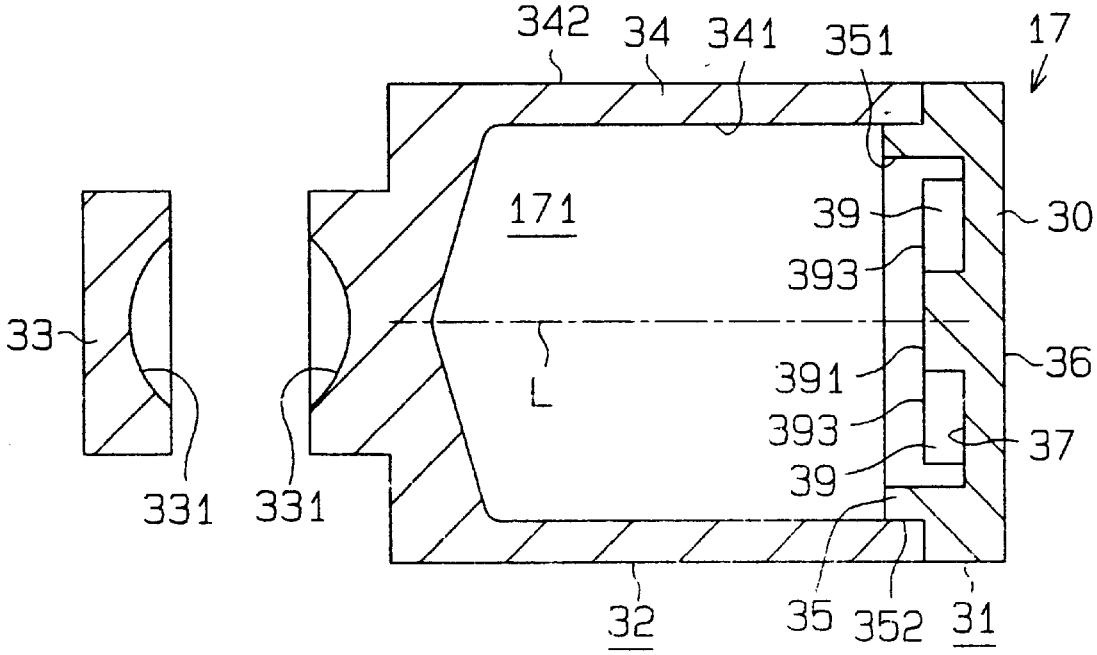
FIG. 3 is a cross-sectional side view taken along the line 3—3 in FIG. 2.

As shown in FIGS. 2 and 3, the interior of each piston 17 includes a hollow space 171. Each piston 17 is constructed by coupling a head 31, which includes a head end wall 30, to a body 32, which contacts the shoes 18. The body 32 has a coupler portion 33, which includes a pair of concave portions 331 for holding the shoes 18, and a peripheral wall 34. The head 31 includes the head end wall 30 and a rim 35.

The rim 35 of the head 31 and the peripheral wall 34 of the body 32 are welded together at their mating surfaces to join the head 31 to the body 32. An inner surface 341 of the peripheral wall 34 is circumferential, and an outer surface 342 of the peripheral wall 34 is circumferential. In addition, an inner surface 351 of the rim 35 and an outer peripheral surface 352 of the rim 35 are circumferential. The inner surface 341, the outer surface 342 of the peripheral wall 34, the inner surface 351 and the outer peripheral surface 352 of the rim 35 share a common axis L, and the axis L is surrounded the hollow space 171.

The head end wall 30 is flat, and an outer end face 36 of the head end wall 30, which faces the inner valve forming plate 21, is parallel with the inner valve forming plate 21. An inner end face 37 of the head end wall 30 also is parallel with the inner valve forming plate 21. As shown in FIG. 4, a plurality of reinforcing projections 39 (6 pieces in the present embodiment) are formed integrally with the inner end face 37. The reinforcing projections 39, or ribs, extend radially from the axis L to the inner surface 351. Inner ends 391 of the reinforcing projections 39 are located at the axis L, and outer ends 392 of the reinforcing projections 39 are connected with the inner peripheral surface 351 of the rim 35. The reinforcing projections 39 are spaced at the same angular intervals around the axis L along a radial line passing through the axis L. In this embodiment, the reinforcing projections 39 are spaced at the equiangular intervals of 60° about the axis L. That is, the reinforcing projections 39 are radially symmetrical. As shown in FIGS. 2 and 3, a projecting end face 393 of the reinforcing projection 39 is parallel to the inner end face 37, and the dimension of the reinforcing projections 39 are the same.

The following effects occur in the first embodiment.

(1-1) The head end wall, which has a simple flat shape, is formed in a right angle form at the joint between the inner end surface of the head end wall and the inner surface 351 of the rim 35. The right angle form makes it easy to concentrate the stress working on its connecting portion. If the thickness of the head end wall is increased, strength against the stress concentration working on the connecting portion of the right angle form is obtained, but the increased pressure at the head end wall induces the weight increase in the head end wall. Accordingly, the stress concentrating on the center portion of the head end wall becomes excessive when the weight increase of the head end wall is controlled so as to be as responsive as possible by designing the wall thickness at a minimum enough to be capable of keeping the head end wall from stress concentration working on the connecting portion of the right angle form.

The reinforcing projections 39 on the inner end face 37 increase the surface area of the inner end face 37. The increase in the surface area of the inner end face 37 reduces stress concentration working against the head end wall 30. Further, the reinforcing projected portions 39 on the inner end face 37 limit the weight of the head end wall 30 compared to simply increasing the thickness of the head end wall 30.

(1-2) The reinforcing projections 39 disperse stress in their longitudinal directions. The reinforcing projections 39 extend in the radial direction, and this disperses stress in the radial direction of the head end wall 30.

(1-3) All the reinforcing projections 39 are connected with the inner surface 351 of the rim 35, which disperses stress at the joints between the rim 35 and the head end wall 30.

(1-4) The inner ends 391 of all the reinforcing projections 39 are located at the axis L, and this disperses the stress that occurs near the axis L of the head end wall 30.

(1-5) Dispersing the stress of the head end wall 30 in the circumferential direction is important, although such dispersal is less than that in the radial direction. The reinforcing projections 39 are spaced at the same intervals around the axis L is advantageous for equalizing the stress dispersion around the axis L, that is, the stress dispersion in the circumferential direction.

(1-6) The head 31, which includes the head end wall 30, is formed by casting, cutting, or pressing. The piston 17, in which the head 31 and the body 32 are coupled, is advantageous for easily forming the reinforcing projection 39 into a predetermined form on the inner end face 37 of the head end wall 30.

Figure 5:
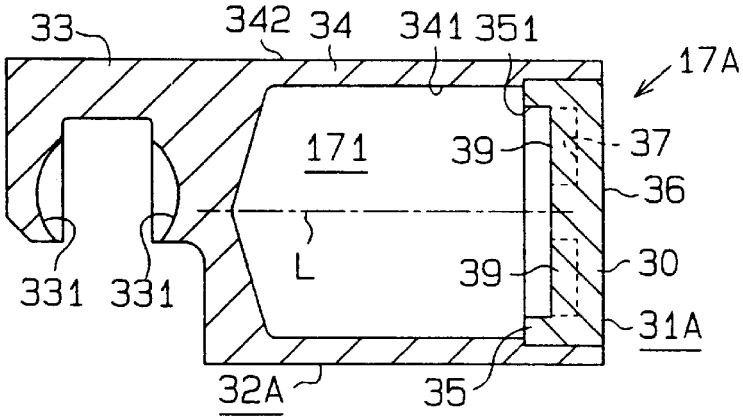
FIG. 5 is a cross-sectional side view of a piston according to a second embodiment of the present invention.

Next, a second embodiment, as shown in FIG. 5, will be described. In this embodiment, components that are the same in the first embodiment bear the same reference numerals used in the first embodiment.

A head 31A, which forms constituting a piston 17A together with a body 32A, is fitted in the body 32A such that the head 31A is entirely housed in the peripheral wall 34 of the body 32A.

Figure 6:
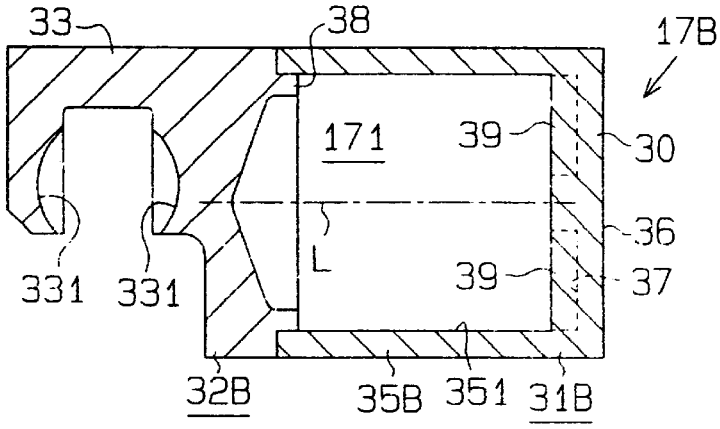
FIG. 6 is a cross-sectional side view of a piston according to a third embodiment of the present invention.

Next, a third embodiment as shown in FIG. 6 will be described. In this embodiment, components that are the same in the first embodiment bear the same reference numerals used in the first embodiment.

In a piston 17B, in this embodiment, a rim 35B, which corresponds to the peripheral wall 34 in the first embodiment, and the head end wall 30 are formed integrally in a head 31B. A base rim 38 is formed in a body 32B. The base rim 38 is fitted into the rim 35B.

The second embodiment and the third embodiment have the same advantages of the first embodiment.

Figure 7A:
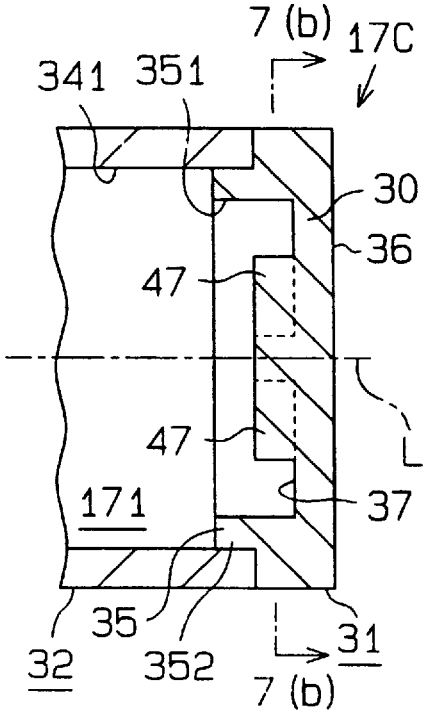
FIG. 7(*a*) is a partial cross-sectional view of the head of a piston according to a fourth embodiment of the present invention.
Figure 7B:
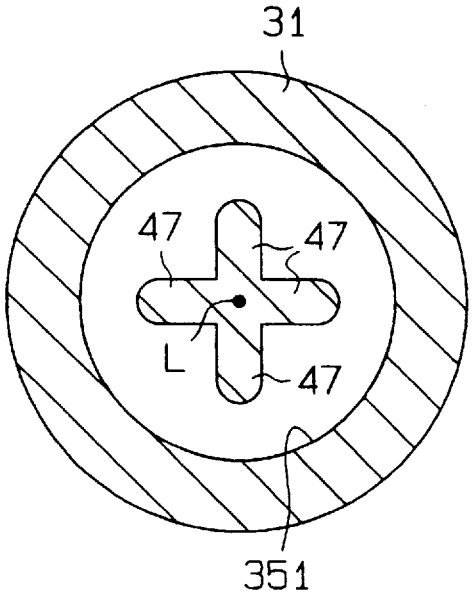

Next, a fourth embodiment, as shown in FIGS. 7(*a*) and 7(*b*), will be described. The same components as in the first embodiment bear the same reference numerals used in the first embodiment.

In a piston 17C of this embodiment, a plurality of reinforcing projections 47 extend from the axis L, and the reinforcing projections 47 and the inner surface 351 of the rim 35 are not connected. The reinforcing projections 47 are located at equal intervals around the axis L along radial lines. The reinforcing projections 47 mainly perform stress dispersion in the vicinity of the axis L.

This embodiment has the advantages (1-1), (1-2), and (1-4) through (1-6) of the first embodiment.

Figure 8A:
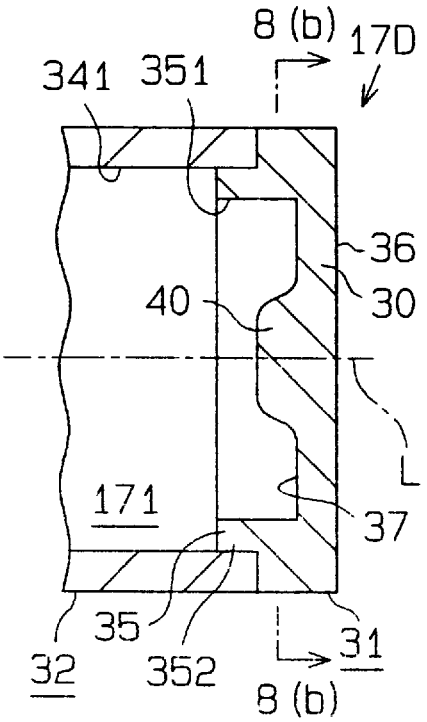
FIG. 8(*a*) is a partial cross-sectional view of the head of a piston according to a fifth embodiment of the present invention.
Figure 8B:
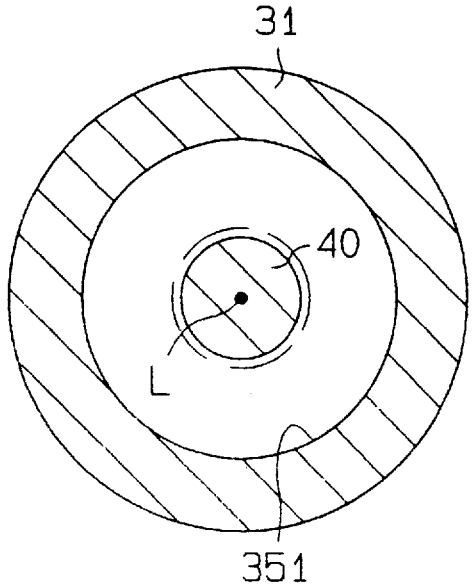

Next, a fifth embodiment as shown in FIGS. 8(*a*) and 8(*b*) will be described. In this embodiment, components that are the same in the first embodiment bear the same reference numerals used in the first embodiment.

A piston 17D includes a cylindrical reinforcing projection 40 centered on the axis L as shown. The reinforcing projection 40 has a radial dimension, and the reinforcing projection 40 is not connected with the surface 351 of the rim 35. The reinforcing projection 40 mainly performs stress dispersion in the vicinity of the axis L. A circumferentially continuous reinforcing projection 40 is optimum for stress dispersion around the axis L, i.e., for equalizing the stress dispersion in the circumferential direction.

This embodiment has the advantages (1-1), (1-2), and (1-4) through (1-6).

Figure 9A:
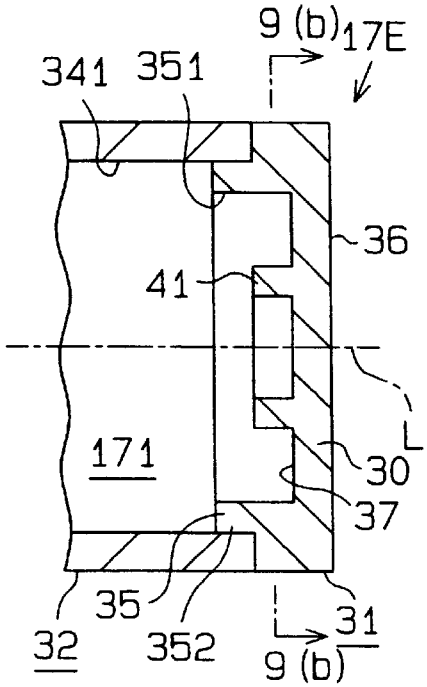
FIG. 9(*a*) is a partial cross-sectional side view of the head of a piston according to a sixth embodiment of the present invention.
Figure 9B:
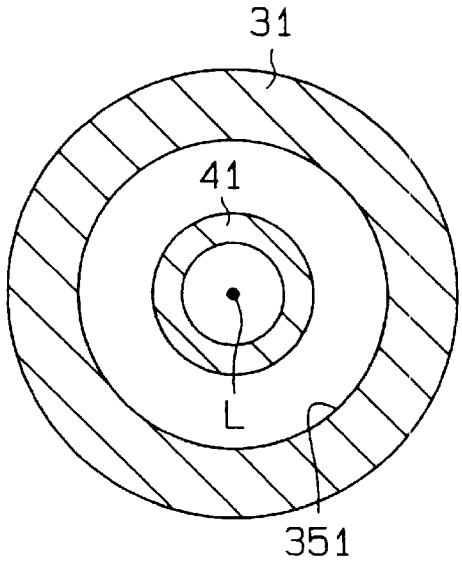

Next, a sixth embodiment as shown in FIGS. 9(*a*) and 9(*b*) will be described. In this embodiment, components that are the same in the first components bear the same reference numerals used in the first embodiment.

A piston 17E has a reinforcing annular projection 41 centered on the axis L. The reinforcing annular projection 41 is radially spaced from the axis L toward the inner surface 351 of the rim 35, but the reinforcing annular projection 41 is not connected with the inner surface 351 of the rim 35. The reinforcing annular projection 41 is optimum for stress dispersion around the axis L, i.e., for equalizing stress dispersion in the circumferential direction.

This embodiment has the advantages (1-1), (1-5) and (1-6) in the first embodiment.

Figure 10A:
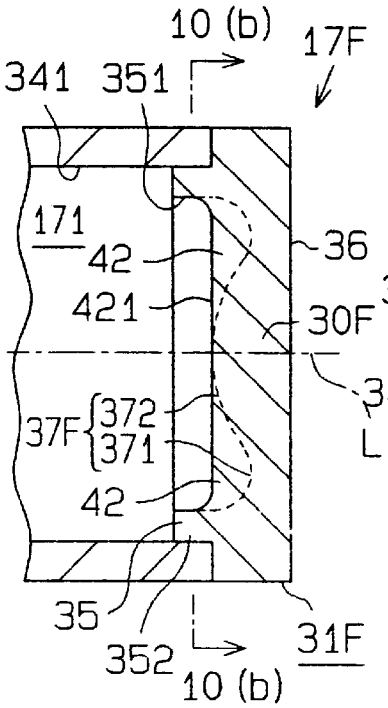
FIG. 10(*a*) is a partial cross-sectional side view of the head of a piston according to a seventh embodiment of the present invention.
Figure 10B:
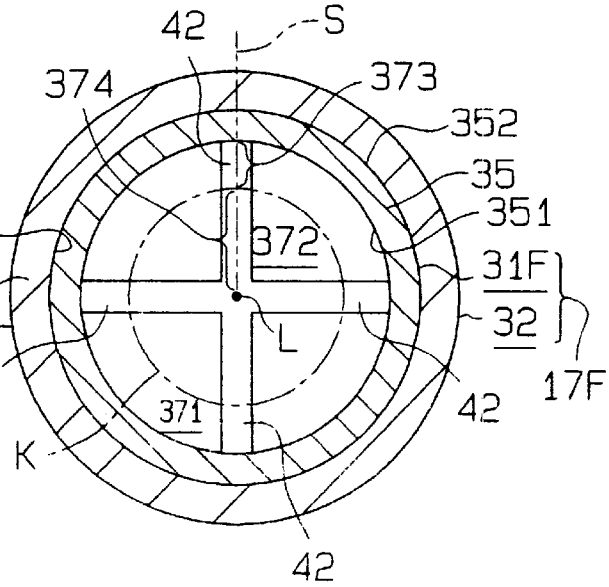

Next, a seventh embodiment as shown in FIGS. 10(*a*) and 10(*b*) will be described. In this embodiment, components that are the same in the first embodiment bear the same reference numerals used in the first embodiment.

A piston 17F has a head 31F, which includes an end face and an end wall 30F. The end face 36 is parallel to the inner valve forming plate 21. An inner face 37F of the head end wall 30F includes an annular concave portion 371, which is continuous with the rim 35, and a central convex portion 372, which is inside the annular concave portion 371. The cross-sectional shape that appears when the annular concave portion 371 is cut at a plane S, which includes the axis L. in FIG. 10(*b*), is shown by an arc 373. The annular concave portion 371 is formed by turning the arc 373 once around the axis L. That is, the arc 373 serves as a base line for the annular concave portion 371. The cross-sectional shape formed when the annular convex portion 37 is cut along the plane S, which includes the axis L, is shown by an arc 374. The convex portion 372 is formed by turning the arc 374 once around the axis L. That is, the arc 374 serve as a base line for the convex portion 372. The convex portion 372 is part of a sphere.

The radial immersion of the arc 373 is smaller than that of the arc 374 as shown in FIG. 10(*b*). On the plane S, the arc 373 joins smoothly with the inner surface 351 of the rim 35, which forms the hollow space 171, and the arc 374 joins smoothly with the arc 373. That is, the annular concave portion 371 blends smoothly with the rim 35, and the convex portion 372 blends smoothly with the annular concave portion 371. The annual concave portion 371 and the convex portion 372 share the axis L of the piston 17.

In FIG. 10(*b*), the region of the annular concave portion 371 is located between the inner surface 351 and the broken line K, and the region of the convex portion 372 is located inside the broken line K.

A plurality of reinforcing projections 42 (4 pieces in the present embodiment) are formed so that they extend radially from the axis L toward the inner surface 351.

The reinforcing projections 42 each extend from the axis L to the inner surface 351 of the rim 35. An end face 421 of the reinforcing projection 42 is parallel with the outer end face 36. The reinforcing projections 42 are spaced at equal intervals around the axis L along radial lines.

The seventh embodiment has the following advantages:

(7-1) The affects of the reinforcing projections 42 are similar to those of the reinforcing projections 39 in the first embodiment.

(7-2) The arc 373 forming the annular concave portion 371 approaches the outer end face 36 of the head end wall 30F and then it curves away from the outer end face 36 from the inner surface 351 toward the axis L. The arc 374 forming the convex portion 372 curves away from the outer end face 36 of the head end wall 30F as it approaches the axis L. The shape of the inner face 37F of the head end wall 30F has favorable stress dispersion characteristics. Specifically, the annular concave portion 71 reduces the stress concentrated at the connecting portion between the rim 35 and the head end wall 30F, and the convex portion 372 reduces the stress concentrated in the head end wall 30F in the vicinity of the axis L. The shade of the inner face 37F makes it possible to decrease the material volume and weight of the head end wall 30F while providing the necessary strength compared with a head end wall that is a simple flat plate.

(7-3) The concave portion 371 and the annular convex portion 372 surrounding the axis L provide optimum stress dispersion and provide adequate strength while decreasing the material volume of the head end wall 30F.

(7-4) The arc 373, which serves as the base line of the annular concave portion 371, is an appropriate shape of the annular concave portion 371 to attain stress dispersion.

(7-5) The arc 374, which serves as the base line of the annular convex portion 372, is an appropriate shape of the convex portion 372 to attain stress dispersion.

Figure 11:
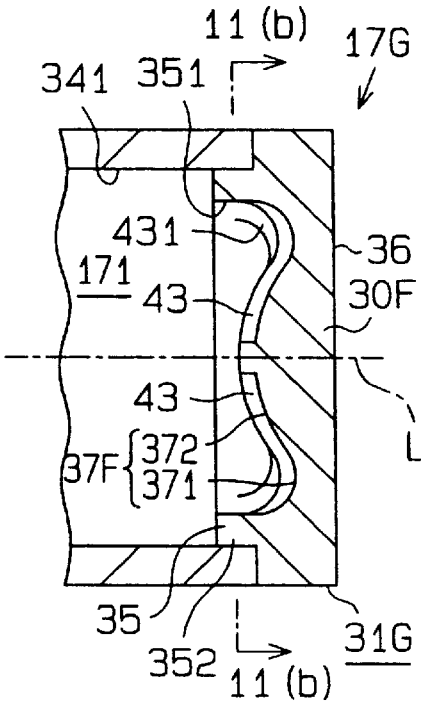
FIG. 11(*a*) is a partial cross-sectional side view of the major part of a piston according to an eighth embodiment of the present invention.
Figure 11:
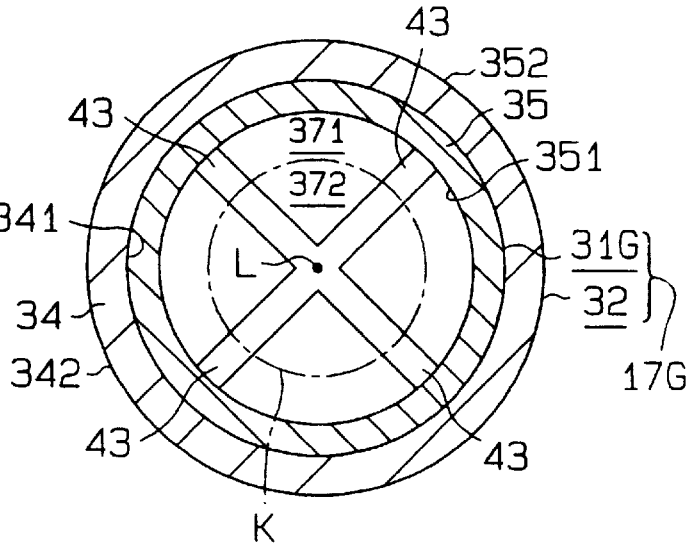

Next, an eighth embodiment shown in FIGS. 11(*a*) and 11(*b*) will be described. In this embodiment, components that are the same in the seventh embodiment bear the same reference numerals used in the seventh embodiment.

In a piston 17G, radial reinforcing projections 43 are provided on an inner face 37F of the head 31G. The reinforcing projections 43 each extend from the axis L to the inner surface 351 of the rim 35. The reinforcing projections 43 are spaced at equal angular intervals around the axis L along radial lines passing through the axis L. The distance between an end face 431 of the reinforcing projection 43 and the concave and convex surfaces 371, 372 is constant. The reinforcing projections 42 have same effects as the reinforcing projections 39 in the first embodiment. The material volume necessary for forming the reinforcing projections 43 for improving the strength of the head end wall 30F is reduced compared to the reinforcing projections 42 of the seventh embodiment.

Figure 12:
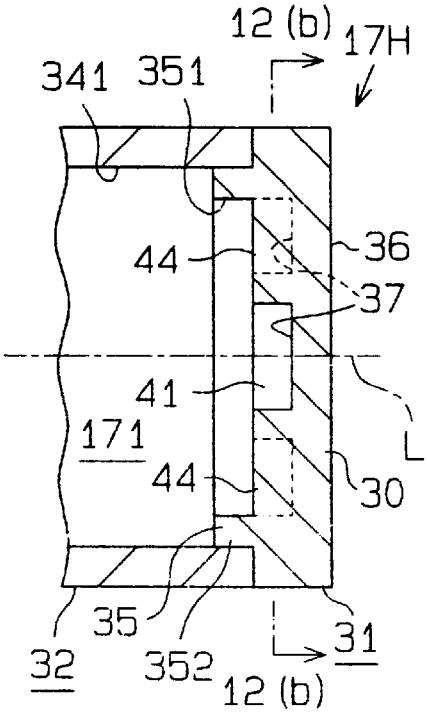
FIG. 12(*a*) is a partial cross-sectional side view of the head of a piston according to a ninth embodiment of the present invention.
Figure 12:
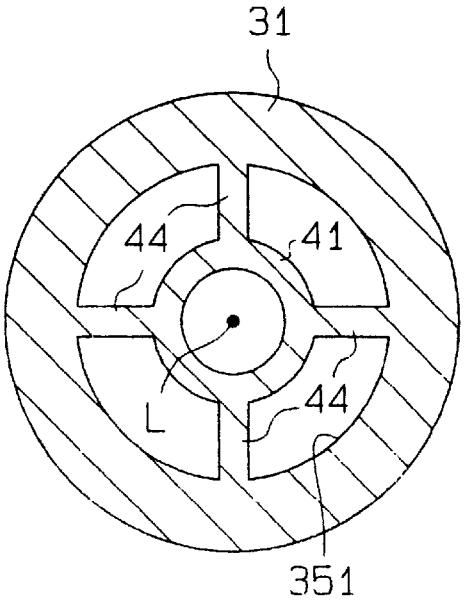

Next, a ninth embodiment as shown in FIGS. 12(*a*) and 12(*b*) will be described. In this embodiment, components that are the same as in the sixth embodiment bear the same reference numeral used in the sixth embodiment.

In a piston 17H, an annular reinforcing projection 41 and the reinforcing projections 44 are provided on the inner end face 37 of the head end wall 30. The reinforcing projections 44 are connected to the outer peripheral surface of the annular reinforcing projection 41 and the inner surface 351 of the rim 35. The reinforcing projections 44 are spaced apart at equal angular intervals around the axis L along radial lines passing through the axis L. The reinforcing annular projection 41 has the same effects as the reinforcing annular projection 41 of the sixth embodiment. The reinforcing projections 44 have advantages (1-2) and (1-3) of the first embodiment.

Figure 13A:
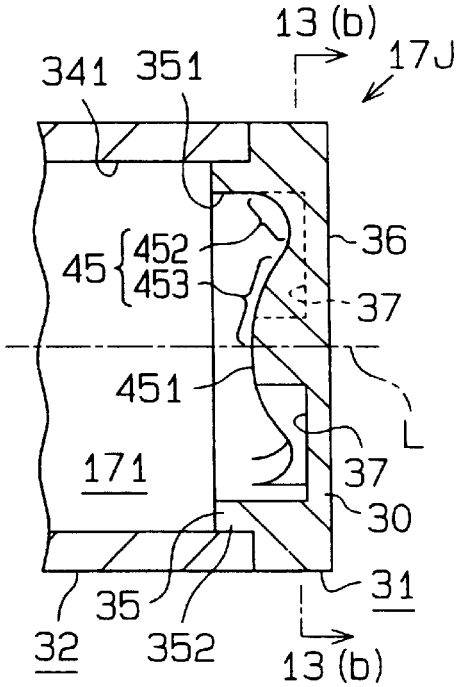
FIG. 13(*a*) is a partial cross-sectional side view of the head of a piston according to a tenth embodiment of the present invention.
Figure 13B:
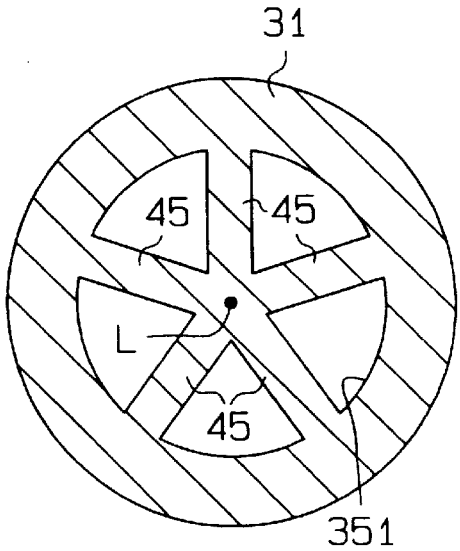

Next, a tenth embodiment as shown in FIGS. 13(*a*) and 13(*b*) will be described. In this embodiment, components that are the same in the first embodiment bear the same reference numerals used in the first embodiment.

In a piston 17J, a plurality of reinforcing projections 45 are provided on the inner end face 37 of the head end wall 30. The reinforcing projections 45 each extend radially from the axis L to the inner surface 351 of the rim 35. The reinforcing projections 45 are spaced apart at equal angular intervals about the axis L along radial lines. An end face 451 of the reinforcing projection 45 approaches the outer end face 36 from the axis L to the inner surface 351 of the rim 35 and then curves away from the outer end face 36. A concave portion 452 of the reinforcing projections 45 reduces the stress concentrated between the rim 35 and the head end wall 30. A convex portion 453 of the reinforcing projections 45 reduces the stress concentration in the head end wall 30 in the vicinity of the axis L.

Figure 14A:
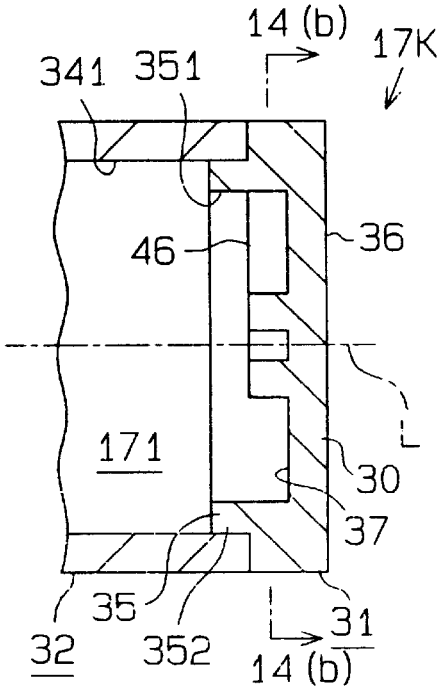
FIG. 14(*a*) is a partial cross-sectional side view of the head of a piston according to an eleventh embodiment of the present invention.
Figure 14B:
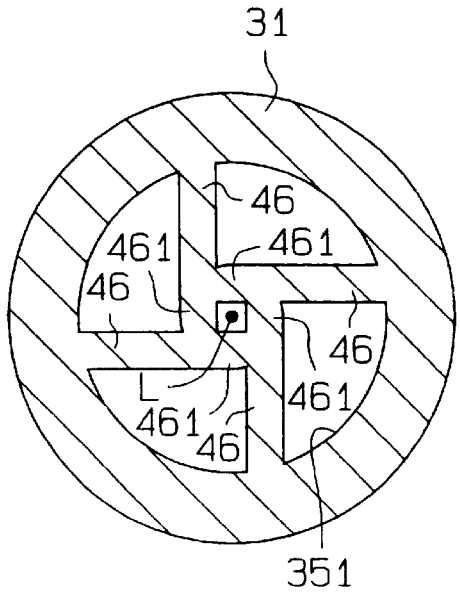

Next, an eleventh embodiment as shown in FIGS. 14(*a*) and 14(*b*) will be described. In this embodiment, components that are the same in the first embodiment bear the same reference numerals used in the first embodiment.

In a piston 17K, a plurality of reinforcing projections 46 are provided on the inner face 37 of the head end wall 30. The reinforcing projections 46 extend toward the inner surface 351 of the rim 35 from the vicinity of the axis L to the inner surface 351 of the rim 351. The inner ends 461 of the reinforcing projections 46 are located near the axis L. The reinforcing projections 46 are not located on radial lines passing through the axis L, but the reinforcing projections 46 are located at equal intervals around the axis L. The reinforcing projections 46 have the same effects as the reinforcing projections 39 in the first embodiment.

Figure 15A:
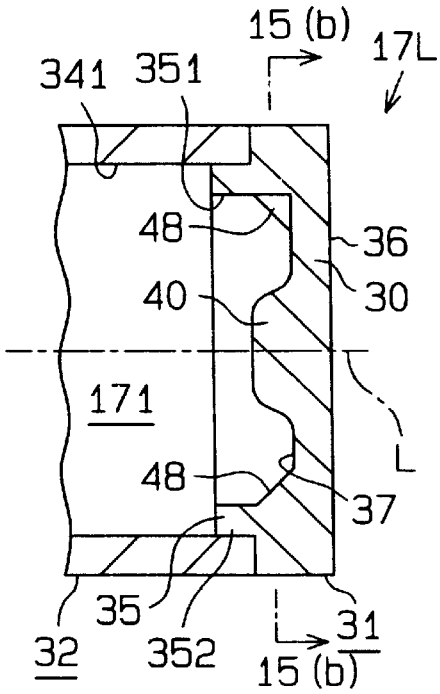
FIG. 15(*a*) is a partial cross-sectional side view of the head of a piston according to a twelfth embodiment of the present invention.
Figure 15B:
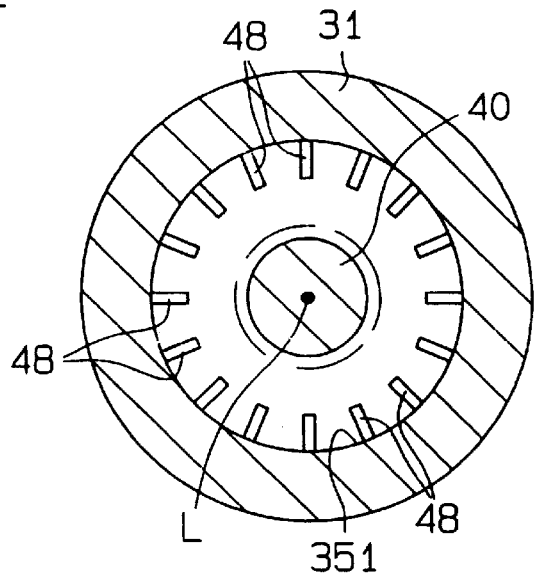

Next, a twelfth embodiment as shown in FIGS. 15(*a*) and 15(*b*) will be described. In this embodiment, components that are the same as in the fifth embodiment bear the same reference numerals used in the fifth embodiment.

In a piston 17L, a central reinforcing projection 40 and a plurality of outer reinforcing projections 48 are provided on the inner face 37 of the head end wall 30. The reinforcing projections 48 are joined to the inner surface 351 of the rim 35 and extend radially toward the axis L. The reinforcing projections 48 are located at equal angular intervals around the axis L. The central reinforcing projection 40 has the same effects as the reinforcing projection 40 of the fifth embodiment. The outer reinforcing projections 48 have the advantage (1-2) of the first embodiment.

Figure 16A:
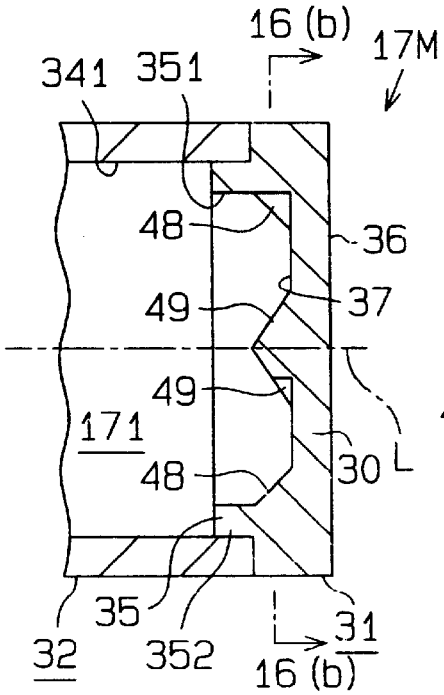
FIG. 16(*a*) is a partial cross-sectional side view of the head of a piston according to a thirteenth embodiment of the present invention, FIG. 16(*b*) is a cross-sectional view taken along the line 16(*b*)—16(*b*) in FIG. 16(*a*)
Figure 16B:
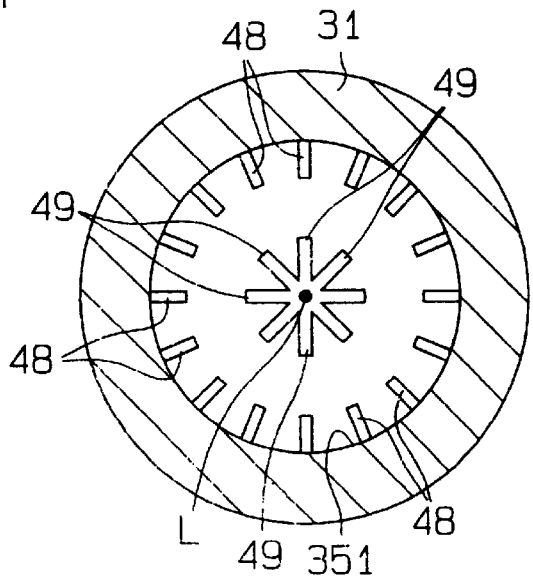

Next, a thirteenth embodiment as shown in FIGS. 16(*a*) and 16(*b*) will be described. In this embodiment, components that are the same in the twelfth embodiment bear the same reference numerals used in the twelfth embodiment.

In a piston 17M, a plurality of inner reinforcing projections 49 and a plurality of outer reinforcing projections 48 are provided on the inner face 37 of the head end wall 30.

The inner reinforcing projections 49 extend radially along lines that pass through the axis L, and are not joined to the inner surface 351 of the rim 35. The outer reinforcing projections 48 have the same effects as the reinforcing projections 47 of the fourth embodiment.

Figure 17:
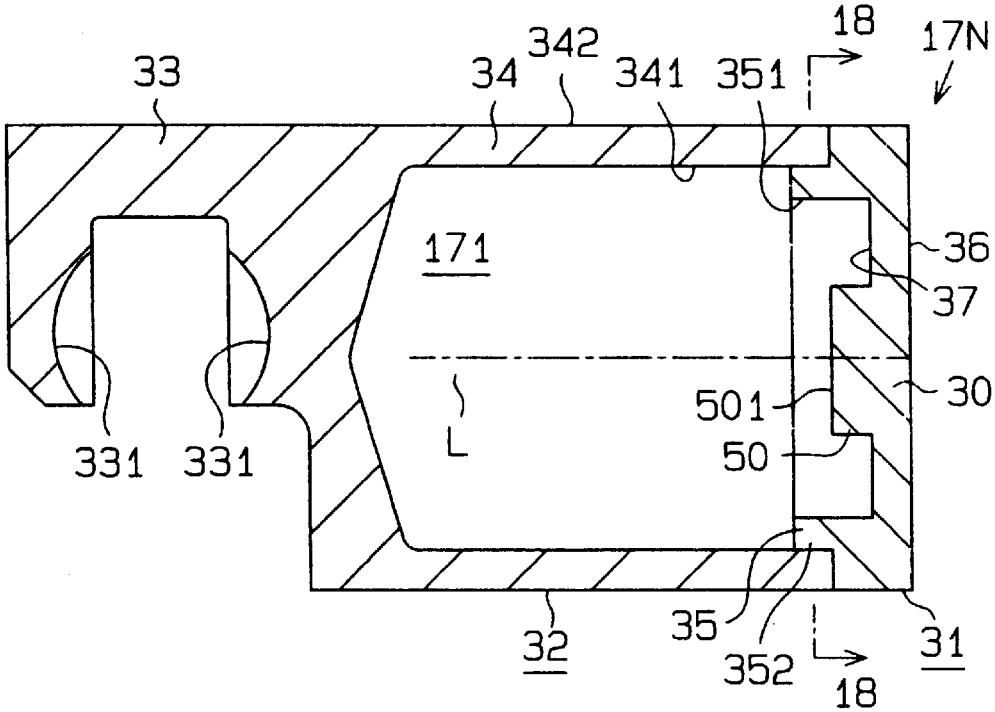
FIG. 17 is a cross-sectional side view of a piston according to a fourteenth embodiment of the present invention.
Figure 18:
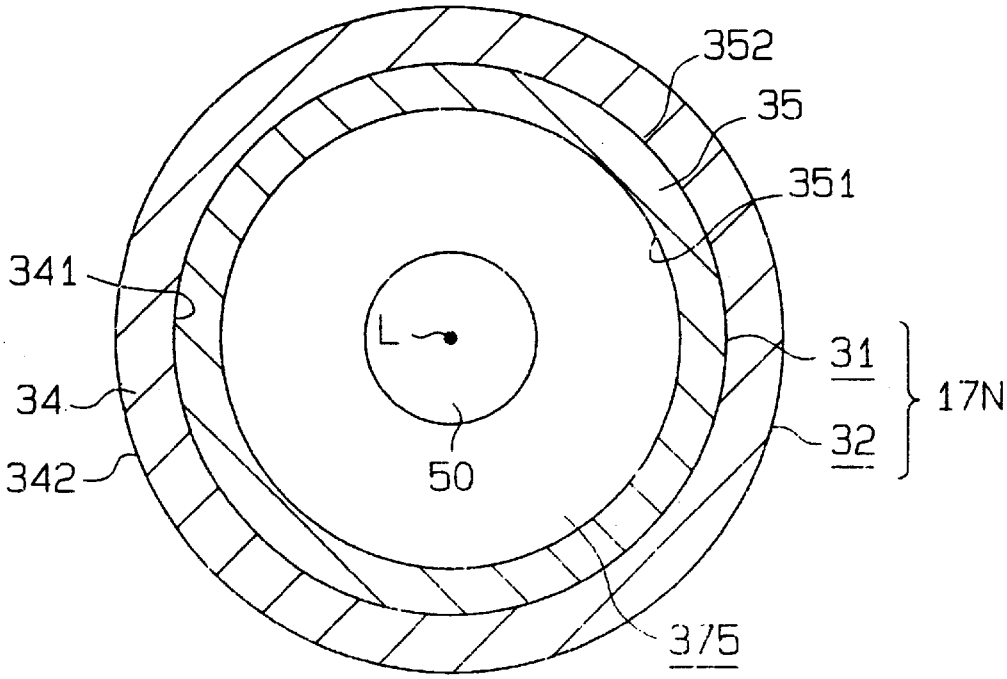
FIG. 18 is cross-sectional view taken along the line 18—18 in FIG. 17.
Figure 19A:
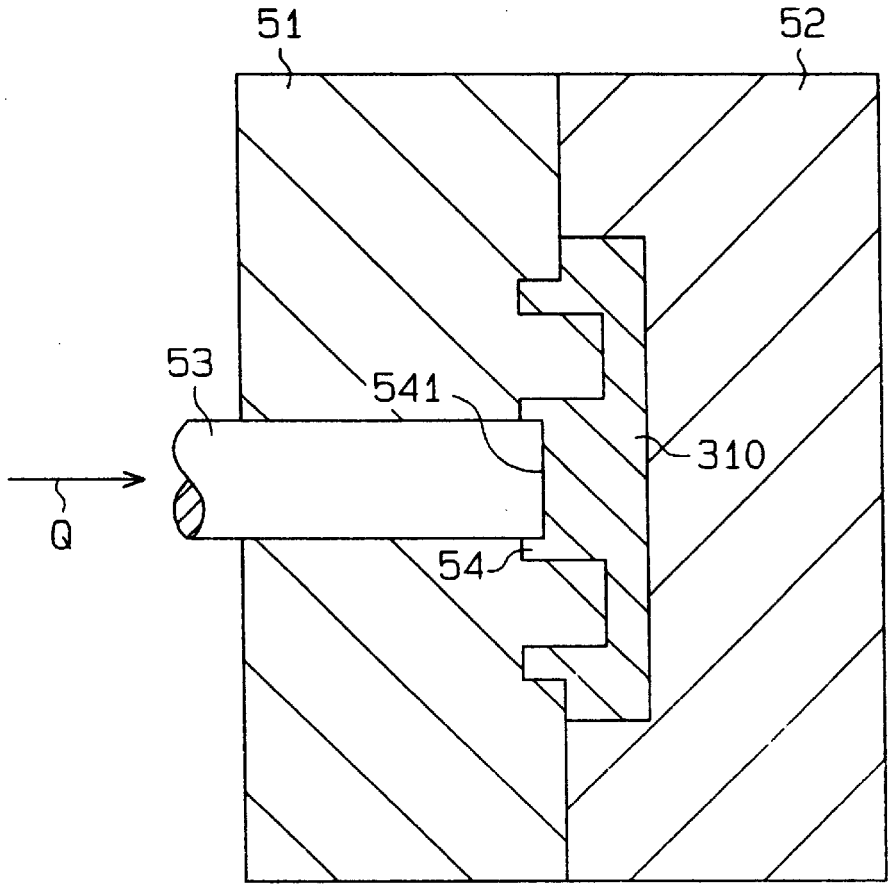
FIG. 19(*a*) is a cross-sectional side view showing a mold in which a welding liquid has been poured.
Figure 19B:
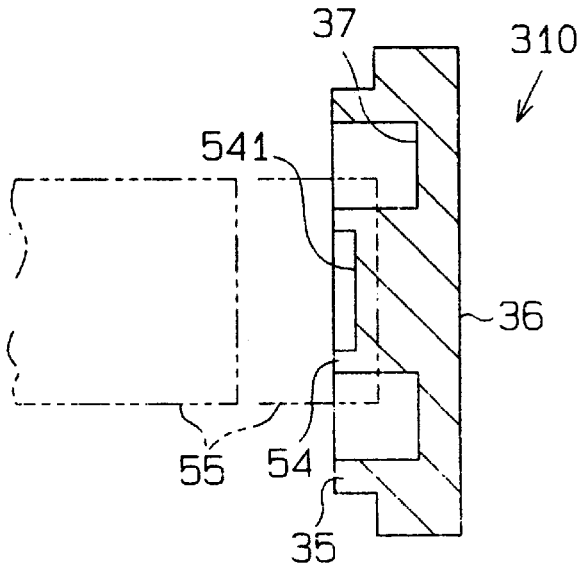

Next, a fourteenth embodiment as shown in FIGS. 17 through 19 will be described. In this embodiment, components that are the same in the first embodiment bear the same reference numerals used in the first embodiment.

In a piston 17N, a cylindrical reinforcing projection 50 is provided on the inner face 37 of the head end wall 30. A head 31, which includes the reinforcing projection 50 is manufactured by pouring molten aluminum into molds 51 and 52, which are set as shown in FIG. 19(*a*). A cylindrical pressing rod 53 is fitted in the mold 51 such that it can slide axially, and a protrusion 54 for preventing a shrinkage cavity is formed in the vicinity of the distal end of the pressing rod 53. The distal end of the pressing rod 53 creates a concave portion 541 in the protrusion 54 for preventing a shrinkage cavity. The molds 51 and 52 form the protrusion 54 for preventing a shrinkage cavity on the inner end face 37 of the head end wall of the head 31. The pressing rod 53 is forced in the direction of an arrow Q as shown in FIG. 19(*a*) before the liquid aluminum poured into the molds 51 and 52 solidifies. The pressing rod 53 applies the pressure to the surface of the protrusion 54 for preventing a shrinkage cavity.

After the metal solidifies, a workpiece 310, which includes the protrusion 54 for preventing a shrinkage cavity, is removed from the molds 51 and 52, and the protrusion 54 is removed with a cutting tool 55 (for example, an end mill) as shown in FIG. 19 (*b*). The machined surface on the inner face 37 that results after cutting the protrusion 54 becomes the projection end face 501. That is, a part of the protrusion 54 becomes the reinforcing projection 50.

The pressure applied to the surface of the protrusion 54 before solidification of the metal prevents a shrinkage cavity from being formed at the head end wall 30 in the vicinity of the axis L, that is, at the head end wall 30 near the projection end face 501. The prevention of a shrinkage cavity of the head end wall 30 while providing the necessary strength of the material reduces the weight of the head end wall 30. The protrusion 54 serves as a reinforcing projection.

The following embodiments are within the scope of the prevent invention.

It should be apparent to those skilled in the art that the present invention may be embodied in many other specific forms without departing from the spirit or scope of the invention. Particularly, it should be understood that the invention may be embodied in the following forms.

(1) In the ninth embodiment, twelfth embodiment and thirteenth embodiment, the reinforcing projections 41, 40, and 49 may be omitted.

(2) In the fourteenth embodiment, the protrusion 54 for preventing a shrinkage cavity may be cut out with the cutting tool 55 so that a part of the concave portion 541 formed in the protrusion 54 for preventing causing of a shrinkage cavity remains by bringing it into contact with the pressing rod 53.

(3) In the seventh embodiment, an annular concave portion defining smooth concave curve except for an arc as a base line may be employed.

(4) In the seventh embodiment, an annular convex portion defining a convex curve except for the arc as a base line may be employed.

(5) In the seventh embodiment, the annular concave portion and the inner surface 351 of the rim 35 may be connected to each other by a tapered surface.

(6) In the seventh embodiment, the annular concave portion and the convex portion may be connected with each other by a tapered surface.

(7) The convex portion 372 of the seventh embodiment may be defined as a curved surface except for a spherical face.

(8) The head and the body may be connected with each other by adhesive.

(9) The head and the body may be connected with each other by friction welding.

(10) The head and the body may be connected with each other by press fitting.

Therefore, the present examples and embodiments are to be considered as illustrative and not restrictive and the invention is not to be limited to the details given herein, but may be modified within the scope and equivalence of the appended claims.

What is claimed is:

1. A hollow piston for use in a swash-plate compressor having a swash-plate and shoes, wherein the piston is accommodated in a cylinder bore of the compressor and rotation of the swash-plate is converted into reciprocating movement of the piston via the shoes, the piston comprising:

a body having a coupling portion engageable with said shoes;

an end wall affixeded to the body, the end wall receives the pressure of the cylinder bore, the end wall having an outer end face and an inner end face that is opposite to the outer end face;

a reinforcing protrusion formed on the inner end face, wherein the reinforcing protrusion is radially symmetrical.

2. The piston according to claim 1, further comprising a cylindrical wall that contacts the wall of the cylinder bore, wherein the reinforcing protrusion is separated from the cylindrical wall.

3. The piston according to claim 2, wherein the reinforcing protrusion and the axis of the piston intersect.

4. The piston according to claim 1, further comprising a cylindrical wall that contacts the wall of the cylinder bore, wherein the reinforcing protrusion is joined to the cylindrical wall.

5. The piston according to claim 4, wherein the reinforcing protrusion and the axis of the piston intersect.

6. The piston according to claim 1, wherein the reinforcing protrusion includes a plurality of ribs that extend radially on the inner end face.

7. The piston according to claim 6, wherein the ribs are arranged at equal angular intervals.

8. The piston according to claim 6, wherein the ribs are joined to one another in the vicinity of the axis of the piston.

9. The piston according to claim 6, further comprising a cylindrical wall that contacts the wall of the cylinder bore, wherein the ribs are joined to the cylindrical wall.

10. The piston according to claim 9, wherein each rib is substantially triangular and is located at a corner defined by the inner end face and the cylindrical wall.

11. The piston according to claim 1, wherein the end wall is flat and circular.

12. The piston according to claim 1, wherein the contour of the inner end face, from the radially outside portion toward the radially inside portion, first approaches the outer end face and then departs from the outer end face.

13. The piston according to claim 12, wherein the inner end face includes an annular concave surface, which is located about the axis of the piston, and a convex surface, wherein the convex surface is located radially inside of and is joined to the concave surface.

14. The piston according to claim 13, wherein the annular concave surface is a smooth curved surface, and wherein the cross section of the concave surface is uniform over the entire circumference about the axis of the piston, wherein the convex surface is a smooth curved surface, and wherein the cross section of the convex surface is uniform over the entire circumference about the axis of the piston.

15. The piston according to claim 1, further comprising a head piece and a body piece that is coupled to the head piece, wherein the head piece includes the end wall, and the body piece includes the remainder of the piston, and wherein, when the head piece an the body piece are separated, the inner end face is exposed.

16. A hollow piston used in a swash-plate compressor having a swash-plate and shoes, wherein the piston is accommodated in a cylinder bore of the compressor and rotation of the swash-plate is converted into reciprocating movement of the piston via the shoes, the piston comprising:

a body having a coupling portion engagable with said shoes;

a flat circular end wall affixed to the body, the flat circular end wall receives the pressure of the cylinder bore, wherein the end wall has an outer end face and an inner end face that is opposite to the outer end face; and a plurality of reinforcing ribs formed on the inner end face, wherein the ribs extend radially from the axis of the piston.

17. A method for manufacturing a hollow piston used in a compressor, where in the piston includes a head piece and a body piece that is coupled to the head piece, wherein the head piece has an end wall that receives the pressure of a cylinder bore of the compressor, and the body piece includes the remainder of the piston, and wherein the end wall has an outer end face and an inner end face that is opposite to the outer end face, the met hod comprising:

preparing a mold for forming the head piece, wherein the mold is designed such that a temporary protrusion is formed on the inner end face;

pouring molten metal into the mold;

pushing the temporary protrusion before the molten metal solidifies to prevent formation of shrinkage cavities; and removing part of the temporary protrusion after the molten metal solidifies, wherein the remainder of the temporary protrusion serves as a reinforcing protrusion.

18. A hollow piston used in a compressor, wherein the piston is accommodated in a cylinder bore of the compressor, the piston comprising:

an end wall that receives the pressure of the cylinder bore, the end wall having an outer end face and an inner end face that is opposite to the outer end face;

a radially symmetrical reinforcing protrusion formed on the inner end face including a plurality of ribs that extend radially on the inner end face, each rib is substantially triangular; and a cylindrical wall that contacts the wall of the cylinder bore, wherein the ribs are located at a corner defined by the inner end face and the cylindrical wall and are joined to the cylindrical wall.

19. A hollow piston used in a compressor, wherein the piston is accommodated in a cylinder bore of the compressor, the piston comprising:

an end wall that receives the pressure of the cylinder bore, the end wall having an outer end face and an inner end face that is opposite to the outer end face, wherein the contour of the inner end face, from the radially outside portion toward the radially inside portion, first approaches the outer end face and then departs from the outer end face and the inner end face includes an annular concave surface, which is located about the axis of the piston, and a convex surface, wherein the convex surface is located radially inside of and is joined to the concave surface; and a reinforcing protrusion formed on the inner end face, wherein the reinforcing protrusion is radially symmetrical.

* * * * *

UNITED STATES PATENT AND TRADEMARK OFFICE

CERTIFICATE OF CORRECTION

PATENT NO. : 6,526,869 B2
DATED : March 4, 2003
INVENTOR(S) : Takayuki Kato et al.

It is certified that error appears in the above-identified patent and that said Letters Patent is hereby corrected as shown below:

Column 4,
Line 39, please add -- by -- after "surrounded".

Column 7,
Line 16, please delete "affects" and insert therefore -- effects --.

Column 10,
Line 30, please delete "affixeded" and insert therefore -- affixed --.
Line 33, please add -- and -- after "face;".
Line 34, please insert -- at least in a center portion -- after "formed".

Column 11,
Line 17, please delete "an" and insert therefore -- and --.

Signed and Sealed this

Fifth Day of August, 2003

JAMES E. ROGAN
*Director of the United States Patent and Trademark Office*